United States Patent [19]

Krob et al.

[11] 4,213,629

[45] Jul. 22, 1980

[54] BRAKE FOR SKIS

[75] Inventors: Erwin Krob, Vienna; Josef Svoboda, Schwechat, both of Austria

[73] Assignee: TMC Corporation, Baar, Switzerland

[21] Appl. No.: 890,790

[22] Filed: Mar. 27, 1978

[30] Foreign Application Priority Data

Apr. 4, 1977 [AT] Austria ..... 2320/77

[51] Int. Cl.[2] ..... A63C 11/02

[52] U.S. Cl. ..... 280/605; 280/814

[58] Field of Search ..... 280/605, 11.37 K, 11.37 A

[56] References Cited

U.S. PATENT DOCUMENTS

| | | | |
|---|---|---|---|
| 4,014,563 | 3/1977 | Weigl et al. | 280/605 |
| 4,036,509 | 7/1977 | Schwarz | 280/605 |
| 4,062,553 | 12/1977 | Riedel | 280/605 |

FOREIGN PATENT DOCUMENTS

| | | | |
|---|---|---|---|
| 2502067 | 7/1976 | Fed. Rep. of Germany | 280/605 |
| 224227 | 7/1943 | Switzerland | 280/11.37 A |

*Primary Examiner*—David M. Mitchell

*Attorney, Agent, or Firm*—Blanchard, Flynn, Thiel, Boutell & Tanis

[57] ABSTRACT

A ski brake mechanism having braking arms on which are provided structure for facilitating a connection of two skis together in a position wherein the running surfaces thereof engage one another at the tips and tails thereof. The structure on the arms of the ski brake is a projection which is received into a crevasse or notch on the opposite side thereof. In the illustrated embodiment, the projection projects laterally inwardly of the arms and the crevasse is provided on the laterally outside thereof.

8 Claims, 8 Drawing Figures

BRAKE FOR SKIS

FIELD OF THE INVENTION

The invention relates to a brake for skis having braking arms which are arranged on both sides of the ski and which are urged under spring tension from a downhill position into a braking position, and which brake arms project in the braking position beyond the bottom surface of the ski in a sloped relation relative to the longitudinal axis of said ski and can be connected to corresponding braking arms of a second ski, which causes the brake to form at the same time as a device for holding the skis together.

BACKGROUND OF THE INVENTION

It is advantageous for transporting and carrying of skis if the skis can be connected in pairs. To assure such a connection, many different auxiliary means have become known. Thus it is possible to hold together skis with the aid of rubber bands, or to clamp them together through specially constructed ski plates on ski poles. All such methods, however, have the disadvantage that at all times separate parts must be used, which are often not available, or, as this is the case with ski poles, which are otherwise needed.

To avoid this disadvantage, one attempts to permit a secure connection of skis in pairs with the aid of parts which are constantly associated with the ski.

Thus a known possibility exists wherein permanent magnets are mounted on the braking arms of the ski brakes, which magnets adhere to one another when the running surfaces of the skis are placed together. This however, has not proven to be practical because the magnets can produce only a very small force so that a good connection between the skis cannot be guaranteed.

A different known possibility to guarantee, with the aid of braking arms of ski brakes, the holding together of pairs of skis consists of recesses being provided on the inside of the braking arms, the length of which recesses corresponds with the thickness of the braking arms. The recesses snap then when the two skis are guided together over the outer surfaces of the braking arms of the second ski and are supported by lateral ribs or the like on said braking arms. Such a construction of the braking arms does permit a secure holding together of the skis, however, on the other hand has the disadvantage that the skis can be released from one another only with great difficulty. This is among other reasons due to the fact that the braking arms, which are necessarily constructed very sturdy, are spanned against one another during a guiding together of the two skis and the recesses can be released again from the inner braking arms therefore only through a spreading apart of the outer braking arms.

Therefore the basic purpose of the invention is to provide a brake for skis, which facilitates both a simple guiding together of the skis and also a simple release thereof.

The invention provides that preferably the inner side surfaces or side edges of the braking arms have at least one cam or the like projecting inwardly therefrom, and that the side surfaces or side edges which are opposite the cam have a crevasse or notch therein.

This construction facilitates a substantially simpler guiding together of both skis, because the braking wings of the one ski can be inserted into the crevasse of the braking wing of the other ski and can be moved relatively easy to the cam, so that only for moving the cam beyond the crevasse a slightly greater force is needed. On the other hand, this construction guarantees, however, a holding force which is sufficiently great in practice for holding the skis together.

The cam is referably constructed so that it is elastically flexible.

It is particularly advantageous when the cam can be elastically embedded into the side surface or side edge of the braking arms.

In a preferred exemplary embodiment, the cam is constructed in one piece with the braking arm as a plastic spring member.

BRIEF DESCRIPTION OF THE DRAWINGS

The invention will be discussed more in detail with reference to the exemplary embodiments illustrated in the drawings, which exemplary embodiments are provided for discussion purposes only and are not to be limiting.

In the drawings.

DETAILED DESCRIPTION

Figure 1:
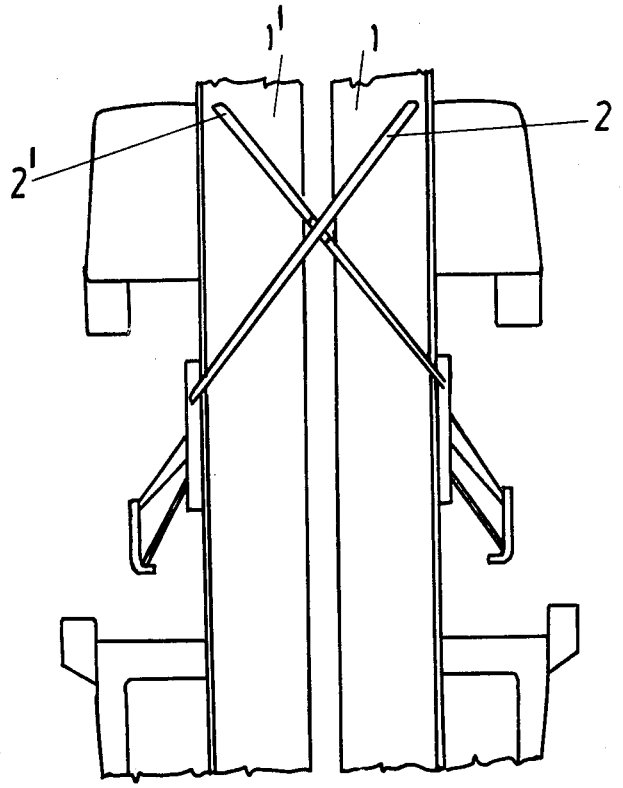
FIG. 1 illustrates two skis which are connected by an inventive brake mechanism.
Figure 2:
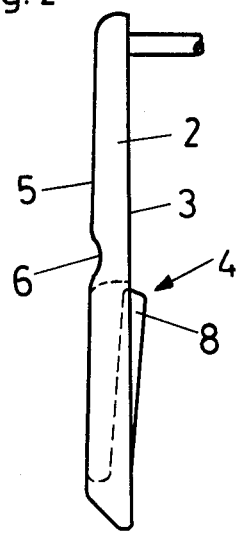
FIGS. 2 and 3 show a plastic spring member functioning as a cam and being constructed in one piece with the braking arm.
Figure 3:
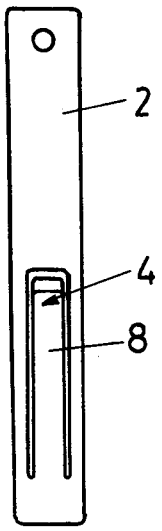

As is illustrated in FIG. 1, the two skis 1 and 1' can be connected together by the braking arms 2 with their running surfaces facing and engaging one another at the tips and tails thereof. The exemplary embodiment which is illustrated in FIGS. 2 and 3 illustrates braking arms 2, which are manufactured out of plastic and have a plastic spring member 8 integrated into the lower area thereof. The plastic spring member which forms the cam 4 projects laterally inwardly of the brake arm and has a flank which faces toward the free end of the braking arm 2, which flank defines a very small angle with the longitudinal axis of the braking arm. A crevasse or notch 6 is provided in the laterally outer surface 5 of the braking arm. If now two skis 1 and 1' are guided toward one another with their running surfaces engaging, then the braking arms 2 of the one ski can be inserted into the crevasse 6 of the braking arms 2 of the other ski. Due to the small angle of inclination of the plastic spring member 8 and due to the flexibility of the same, the skis can be guided together easily and without any special amount of force being required. If the running surfaces have reached the desired spacing between one another, the plastic spring members 8 of the outer braking arms 2 yield inwardly and snap back to the original position thereof and grip behind the innermost braking arms 2'. The steep flank of the cams 4 now assures a secure connection of the skis.

When the two skis are to be released from one another, it is possible either to press the plastic spring members 8 manually inwardly, however, depending on the strength of the plastic spring member 8 and on the angle thereof relative to the longitudinal axis of the ski and the degree of engagement therebetweeen, a simple pulling on the two skis may be sufficient.

Figure 4:
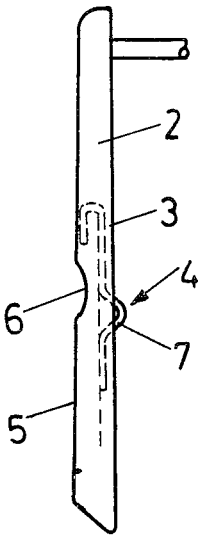
FIG. 4 illustrates a different cam construction utilizing a steel spring member which is injected molded into the braking arm.

FIG. 4 illustrates an exemplary embodiment, which in place of a plastic spring member 8, utilizes a steel spring wire 7, which is injected molded into the braking arm 2.

Figure 5:
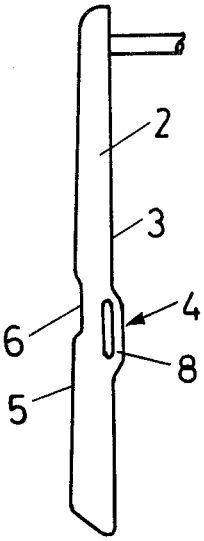
FIG. 5 illustrates a further possibility for a plastic spring member.
Figure 6:
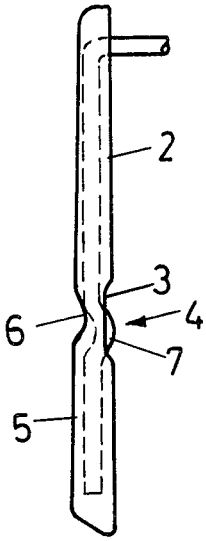
FIGS. 6 and 7 illustrate nonelastic cams made of steel bars.
Figure 7:
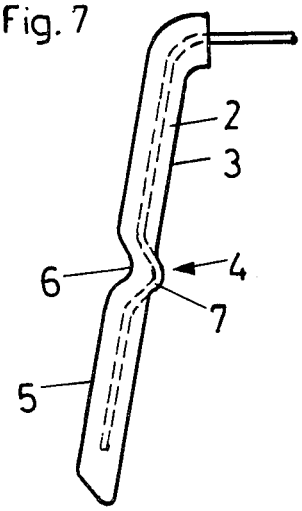
Figure 8:
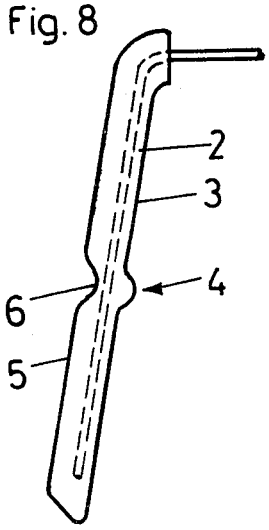
FIG. 8 illustrates a particularly simple exemplary embodiment.

The exemplary embodiment illustrated in FIG. 5 shows the form of a plastic spring member 8 functioning as a cam 4. FIGS. 6 and 7 illustrate exemplary embodiments, in which the supporting part of the braking arms is formed by a wire. The cam 4 is therefore formed in a simple manner by a bend in the wire bar 7, which brings about the advantage of a very good resistance to wear. In the exemplary embodiment which is illustrated in FIG. 8, the cam 4 is formed out of the plastic of the braking wings rather than the wire in the embodiment of FIG. 8.

Although particular preferred embodiments of the invention have been disclosed in detail for illustrative purposes, it will be recognized that variations or modificiations of the disclosed apparatus, including the rearrangement of parts, lie within the scope of the present invention.

The embodiments of the invention in which an exclusive property of privilege is claimed are defined as follows:

1. A device for securing the skis of a pair together, each of said skis having a pair of longitudinal edges, comprising:

a ski brake mounted on the upper surface of each of said skis, each of said ski brakes having a braking arm projecting in the braking position thereof beneath the bottom surface of said ski and along a longitudinal edge of said ski and at an acute angle to a plane defined by the upper surface of said ski; and elastically deformable means on said braking arm projecting from a first surface thereof, said first surface on a first braking arm associated with a first ski engaging a second surface on a second braking arm associated with a second ski when said first and second skis are positioned bottom-to-bottom, said first and second braking arms thereby defining a cross, said elastically deformable means on said first braking arm being in an undeformed condition thereof on a side of said second braking arm remote from said first ski to thereby hold said skis together in said bottom-to-bottom position.

2. The device according to claim 1, wherein said elastically deformable means comprises an elongated spring member integral with the material of said braking arm.

3. The device according to claim 2, wherein said elongated spring member is integrally attached at one end to said braking arm, the remaining free end thereof projecting from said first surface.

4. The device according to claim 3, wheren said braking arm has an opening therein, wherein said one end of said spring member is secured to said braking arm at a location in said opening, said spring member extending coextensively with said opening, said spring member being elastically deformable into said opening, the elasticity of the material of said spring member returning same to said position projecting from said first surface.

5. The device according to claim 1, wherein said braking arm has a further surface on a side thereof remote from said elastically deformable means, said further surface having a notch therein, said elastically deformable means being received in a notch of an associated braking arm.

6. The device according to claim 1, wherein said braking arm and said elastically deformable means are integrally formed of plastic.

7. The device according to claim 1, wherein said elastically deformable means is a spring wire embedded in the material of said braking arm, said spring wire having a part thereof projecting from said first surface.

8. The device according to claim 1, wherein said elastically deformable means comprises an elongated spring member integral with the material of said braking arm, said spring member being arched above said first surface and integrally attached at opposite ends to said first surface of said braking arm.

* * * * *